US007740370B2

(12) United States Patent
Campbell et al.

(10) Patent No.: US 7,740,370 B2
(45) Date of Patent: Jun. 22, 2010

(54) MODULAR STORAGE CONTAINER

(75) Inventors: Joan E. Campbell, Arlington, VA (US); Barry E. Claybrook, Arlington, VA (US); Bradley S. Kell, Pembroke, MA (US); Stephen C. Antonucci, Hendersonville, NC (US)

(73) Assignee: Sleek Stax, LLC, Arlington, VA (US)

( * ) Notice: Subject to any disclaimer, the term of this patent is extended or adjusted under 35 U.S.C. 154(b) by 147 days.

(21) Appl. No.: 12/182,055

(22) Filed: Jul. 29, 2008

(65) Prior Publication Data

US 2010/0025285 A1 Feb. 4, 2010

(51) Int. Cl.
*F21V 33/00* (2006.01)
*A45D 33/24* (2006.01)

(52) U.S. Cl. ..... 362/135; 362/136; 362/144; 362/154; 132/286; 132/294; 132/316

(58) Field of Classification Search ..... 362/135–144; 132/288, 293, 294, 296, 300, 301, 304, 312, 132/314, 316, 286, 291
See application file for complete search history.

(56) References Cited

U.S. PATENT DOCUMENTS

| | | | |
|---|---|---|---|
| 1,190,203 | A | 7/1916 | Sorge, Jr. |
| 2,077,219 | A | 4/1937 | Conner |
| 2,270,636 | A | 1/1942 | Klarfield |
| 2,514,573 | A | 7/1950 | Harrison |
| 3,188,157 | A | 6/1965 | Rand |
| 3,441,033 | A | 4/1969 | Flax |

(Continued)

FOREIGN PATENT DOCUMENTS

| | | | |
|---|---|---|---|
| JP | 09-000342 | A | 1/1997 |

(Continued)

OTHER PUBLICATIONS

International Search Report from counterpart Int. Appl. No. PCT/US2009/050557 mailed Feb. 4, 2010.

(Continued)

*Primary Examiner*—Jacob Y Choi
(74) *Attorney, Agent, or Firm*—Law Office of Peter G. Korynyk, PLLC

(57) ABSTRACT

A modular storage container adapted to hold cosmetics or other small items in a stylish and sleek way is provided. The modular storage container can include a base unit having a first side and a second side, one of a mirror and magnifying device being arranged on the first side of the base unit, an illumination assembly for illuminating the mirror, and a removable cover. The removable cover can be adapted to secure to the first side of the base unit and to protect one of the mirror and magnifying device in a first secured position of the cover. The second side of the base unit is capable of being secured to one or more of a plurality of modular storage units in a stacked relationship. The second side of the base unit can be capable of being secured to the cover in a second secured position of the cover. The first side of the base unit can be adapted to secure to a first end of the cover and the second side of the base unit can be adapted to secure to a second end of the cover.

21 Claims, 4 Drawing Sheets

U.S. PATENT DOCUMENTS

| | | | | |
|---|---|---|---|---|
| 3,714,411 | A | 1/1973 | Waters et al. | |
| 4,421,127 | A | 12/1983 | Geer | |
| 4,589,430 | A | 5/1986 | Sussman | |
| 4,807,773 | A | 2/1989 | Tsai | |
| 4,826,014 | A | 5/1989 | Schefer | |
| 4,831,730 | A * | 5/1989 | Cerier | 30/47 |
| 5,005,697 | A | 4/1991 | Jimbo et al. | |
| 5,318,053 | A | 6/1994 | Barnhart | |
| D350,460 | S | 9/1994 | Picozza et al. | |
| 5,425,971 | A | 6/1995 | Chiang-Cheng | |
| 5,513,754 | A | 5/1996 | Chang | |
| D377,757 | S | 2/1997 | Bertolini et al. | |
| 5,638,839 | A | 6/1997 | Montoli | |
| 5,813,420 | A | 9/1998 | Sussman | |
| 5,832,941 | A | 11/1998 | Murillo | |
| 5,845,658 | A | 12/1998 | Sussman | |
| 6,041,935 | A | 3/2000 | Yang | |
| 6,129,089 | A * | 10/2000 | Yuhara | 132/300 |
| 6,145,515 | A | 11/2000 | Wu | |
| 6,223,754 | B1 | 5/2001 | Burdi et al. | |
| D471,321 | S | 3/2003 | Lai | |
| 6,540,083 | B2 | 4/2003 | Shih | |
| 6,568,529 | B2 | 5/2003 | McMurrey | |
| 6,619,297 | B2 | 9/2003 | Sheng | |
| 6,745,900 | B2 | 6/2004 | Lambert | |
| 6,854,472 | B2 | 2/2005 | Yunakov | |
| 6,932,220 | B2 | 8/2005 | Byun | |
| D517,737 | S | 3/2006 | Lai | |
| D533,310 | S | 12/2006 | Kuo | |
| D549,393 | S | 8/2007 | Jackel-Marken | |
| 7,270,440 | B2 | 9/2007 | Levy et al. | |
| 7,311,416 | B1 | 12/2007 | Kudma | |
| D560,312 | S | 1/2008 | Washington | |
| 7,393,155 | B2 * | 7/2008 | Riccobene | 404/38 |
| 2004/0129600 | A1 | 7/2004 | Gueret | |
| 2004/0244812 | A1 * | 12/2004 | Seidler et al. | 132/301 |
| 2006/0201529 | A1 | 9/2006 | Huang | |
| 2006/0231116 | A1 | 10/2006 | Kaiser et al. | |
| 2007/0131240 | A1 | 6/2007 | Prague | |

FOREIGN PATENT DOCUMENTS

| | | | |
|---|---|---|---|
| JP | 09-010032 | A | 1/1997 |
| KR | 20-108877 | Y1 | 6/1996 |
| KR | 10-0332575 | B1 | 4/2002 |
| KR | 10-0474729 | B1 | 2/2005 |
| KR | 10-0543797 | B1 | 1/2006 |

OTHER PUBLICATIONS

Written Opinion of the International Searching Authority from counterpart Int. Appl. No. PCT/US2009/050557 mailed Feb. 4, 2010.

* cited by examiner

MODULAR STORAGE CONTAINER

FIELD OF THE INVENTION

The present teachings relate to a modular storage container. In particular, the present teachings relate to a stylish modular storage container adapted to hold various small items, such as, cosmetics.

BACKGROUND OF THE INVENTION

Modular storage containers are useful for carrying and organizing small items, including cosmetics. Modular storage containers can be especially useful when it is desired to selectively carry one or more items related to personal makeup and its application, including mirrors, blush, lipstick, eye shadow, and the like.

Prior art modular storage containers are oftentimes non-stylish in appearance and lack useful features, such as, for example, an illumination source or, for further example, a positionable mirror or magnifying device. Prior art modular storage containers also do not provide convenient features such as a storage cover that can cover the modular storage container when not in use, or can serve as an elevated support base when the modular storage container is being used.

Accordingly, there is a need for an aesthetically pleasing modular storage container having useful and convenient features as described.

SUMMARY OF THE INVENTION

A modular storage container is provided. The modular storage container can include a base unit having a first side and a second side. One of a mirror and magnifying device can be arranged on the first side of the base unit. The modular storage container can also include an illumination assembly arranged on the first side of the base unit. The modular storage container can further include a removable cover adapted to secure to the first side of the base unit and protect one of the mirror and magnifying device, as well as the illumination assembly in a first secured position of the cover. The second side of the base unit can be capable of being secured to one of a plurality of modular storage units.

Additional features and advantages of various embodiments will be set forth, in part, in the description that follows, and will, in part, be apparent from the description, or may be learned by the practice of various embodiments. The objectives and other advantages of various embodiments will be realized and attained by means of the elements and combinations particularly pointed out in the description herein.

It is to be understood that both the foregoing general description and the following detailed description are exemplary and explanatory only, and are intended to provide an explanation of various embodiments of the present teachings.

DETAILED DESCRIPTION OF THE PREFERRED EMBODIMENTS

Figure 1:
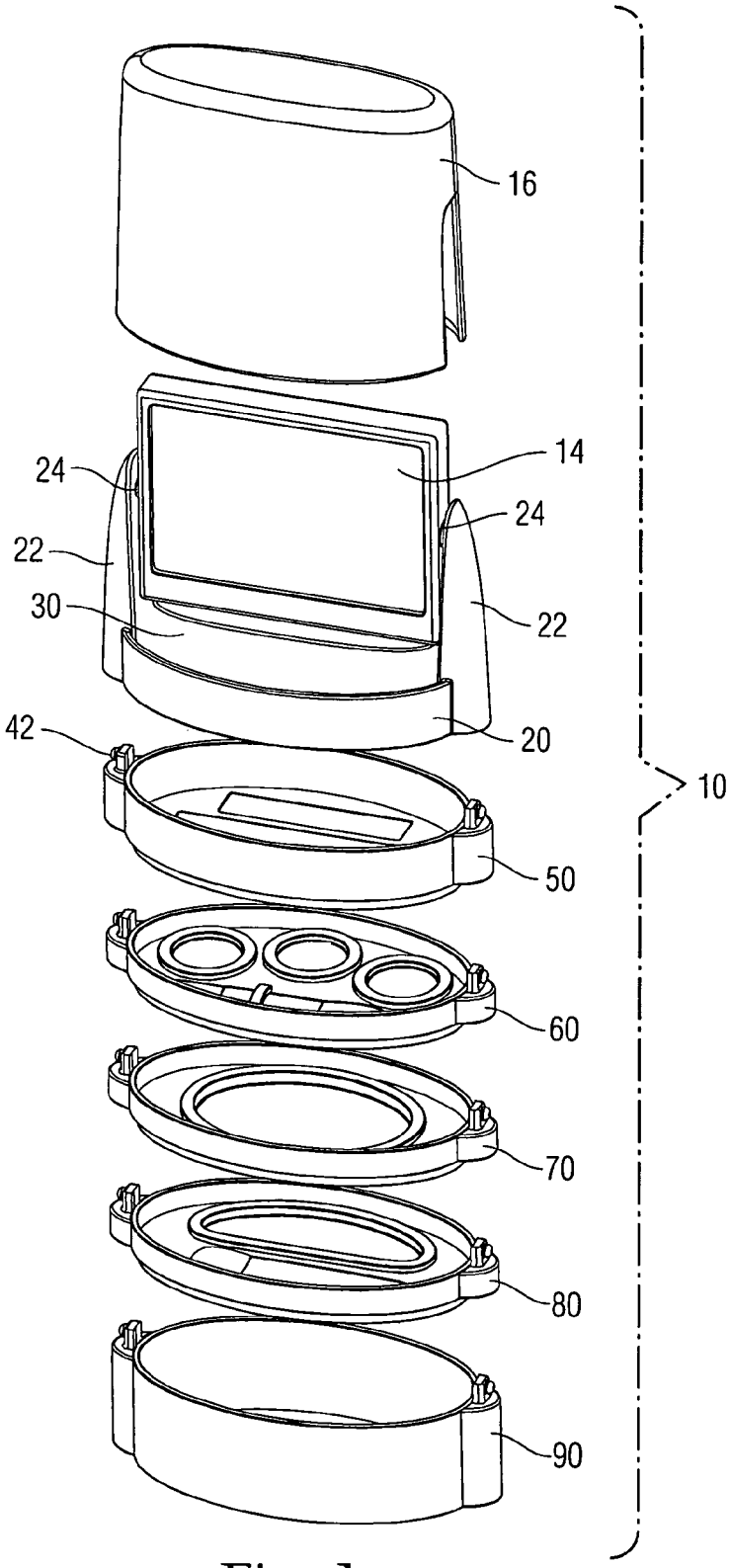
FIG. 1 is an exploded perspective view of a modular storage container of the present teachings.

Referring to FIG. 1, a modular storage container 10 of the present teachings is shown. According to various embodiments, the modular storage container 10 can include a base unit 20 having a first top side and a second bottom side. One of a mirror or a magnifying device 14 can be arranged on the first top side of the base unit 20. An illumination assembly (not shown in FIG. 1) can also be arranged on the first top side of the base unit 20. The illumination assembly can illuminate at least one of the mirror 14 and an area in front of the mirror 14, for example, the area where a person's face would be located when looking into the mirror 14. A diffusion cover 30 can be arranged to cover the illumination assembly and can be mounted flush against a surface of base unit 20. The diffusion cover 30 can operate to diffuse light in order to achieve an optimum lighting effect for the application of makeup, and the like.

Figure 3:
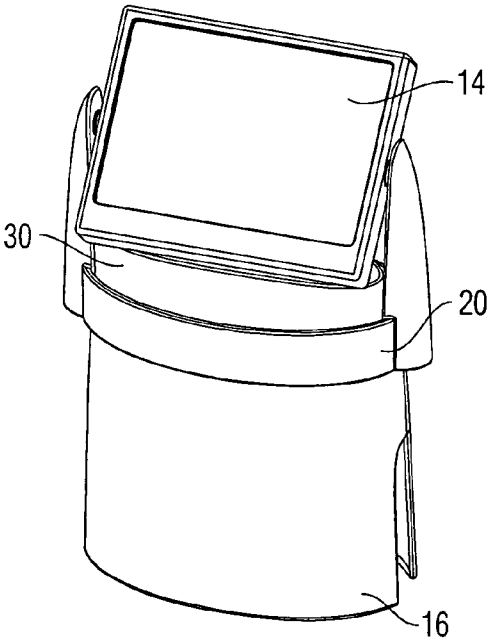
FIG. 3 is a perspective view of the modular storage container of the present teachings with the cover removed and being used as a support.

The modular storage container 10 can include a removable cover 16 that can be adapted to secure to the first top side of the base unit 20. In a first secured position of the cover 16, the removable cover 16 can protect the mirror or magnifying device 14 and the illumination assembly. The second bottom side of the base unit 20 is capable of being selectively secured to one of a plurality of different modular storage units, such as units 50, 60, 70, 80, and 90. As will be described more fully below, the removable cover 16 can also secure to the second bottom side of the base unit 20 and act as an elevating support during use, as shown in FIG. 3.

Depending on the storage needs of the user, one or more of the modular storage units 50, 60, 70, 80, and 90 can be detachably secured sequentially to the bottom side of the base unit 20 in a stacked relationship. The removable cover 16 can then be secured to the bottom side of the bottommost modular storage unit 50, 60, 70, 80, and 90 and act as a support during use.

The components of the modular storage container 10 can be made of any suitable material. For example, the container 10 can be made from a polymer, or more than one polymer. The polymer can be, for example, polystyrene, acrylonitrile butadiene styrene (ABS), polyurethane, polycarbonate, and combinations thereof, or the like. The polymer can, when solidified, have a consistency such that it is hard to the touch. The polymer can, when solidified, have a consistency that is slightly or partially elastic to the touch. For further example, the container 10 can be covered, at least in part, with leather or a synthetic material that has the feel of leather. The container 10 can be covered, at least in part, with suede or a synthetic material that has the feel of suede.

The components of the modular storage container 10 can be made from, in whole or in part, or covered with, in whole or in part, a light metal, such as, for example, a light metal alloy. The container 10 can be made from, in whole or in part, or covered with, in whole or in part, a steel, for example, stainless steel. The container 10 can be made from, in whole or in part, or covered with, in whole or in part, chrome. The container 10 can be made from, in whole or in part, or covered with, in whole or in part, titanium or a material that looks, feels, or both, like titanium. The container 10 can be made from, in whole or in part, or covered with, in whole or in part, carbon fiber or a material that looks, feels, or both, like carbon fiber. The container 10 can be made from or covered with combinations of two or more different materials.

The modular storage container 10 can have a color or tint to the exterior surfaces, interior surfaces, or both. The container 10 can have a combination of two or more different colors on one or more different portions of the container. For example, the titanium exterior of the container can have a light pink color. For further example, the titanium exterior of the cover of the container 10 can have a light pink color. For further example, the titanium exterior of the cover 16 of the container 10 can have a light pink color and the faux carbon fiber interior of the base unit 20 can have a black or dark gray color.

The mirror or magnifying device 14 can be arranged in a fixed position relative to the base unit 20, or can be arranged to pivot. For example, as shown in FIGS. 1 and 3, the mirror or magnifying 14 can be arranged to pivot about an axis extending substantially parallel with respect to an axis extending through the width of the base unit 20. The mirror or magnifying device 14 can be arranged to pivot about pivot pins 24 arranged on support arms 22 formed on the base unit 20. The mirror or magnifying device 14 can be arranged to pivot through a number of discrete positions along the substantially horizontal axis. Alternatively, the mirror or magnifying device 14 can be arranged relative to the base unit 20 such that the mirror or magnifying device 14 can pivot along a substantially vertical axis with respect to the base unit 20. For example, the mirror or magnifying device 14 can pivot 360 degrees about this substantially vertical axis. Moreover, the mirror or magnifying device 14 can pivot through a number of discrete positions along the substantially vertical axis. The mirror or magnifying device 14 can be arranged relative to the base unit 20 such that the mirror or magnifying device 14 can pivot along each of a substantially horizontal axis and a substantially vertical axis, or any other axis.

The mirror 14 can be arranged to provide a 1:1 magnification of an image appearing in the mirror 14, or can be arranged to magnify the image. Alternatively, a first side of the mirror 14 can be arranged to provide a 1:1 magnification of an image appearing in the mirror, while a second side of the mirror 14 can be arranged to magnify the image appearing in the mirror.

The magnifying device 14 can be a magnifying glass, a Fresnel lens, or any other device which would operate to magnify an image.

Figure 4:
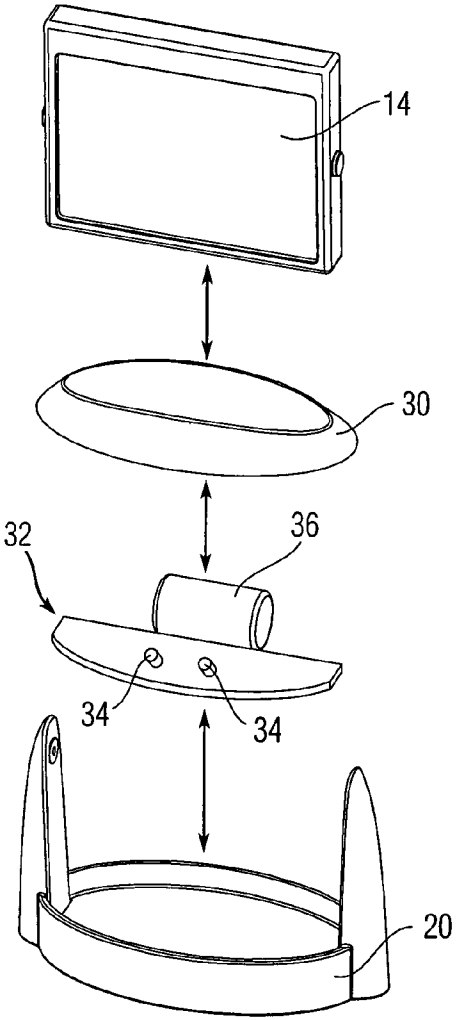
FIG. 4 is an exploded view of various components of a base unit of the modular storage container of the present teachings.

As shown in FIG. 4, the modular storage container 10 of the present teachings can include an illumination assembly 32. The illumination assembly 32 can include any suitable illumination source 34. For example, the illumination assembly 32 can include a light emitting diode (LED), an incandescent illumination source, a fluorescent illumination source, a compact fluorescent illumination source, and the like. For example, the illumination assembly 32 can include one or more bulbs or LEDs 34. The one or more bulbs or LEDs 34 can include one or more colors or hues. For example, the one or more bulbs or LEDs 34 can include one LED tinted a first color and another LED tinted a second color. The colors can be used to simulate, for example, outdoor lighting conditions, indoor lighting conditions, evening lighting conditions, or the like, such that a person applying makeup could simulate lighting conditions different from the lighting conditions at the moment that the person is applying makeup.

The illumination assembly 32 can be connected to at least one battery 36. The battery 36 can be of any suitable size or type. The battery 36 can be, for example, a nickel cadmium battery, a lithium ion battery, a nickel-metal hydride battery, a lithium-chemistry battery, an alkaline battery, or the like. The battery 36 can be, for example, a double-A (AA) battery, a triple-A (AAA) battery, a 123 battery, a 4.5V battery, a 9V battery, an A23 battery, a quadruple-A (AAAA) battery, a C battery, a CR battery, or the like. The battery 36 can be connected removably to an electrical connection such that the battery 36 can be connected to an exterior electrical source, e.g., a wall outlet, to recharge the battery 36. For example, a DC outlet can be affixed to a side of the base unit 20 such that a DC adapter capable of converting 120 VAC power to a low voltage DC current can be connected at one end to the DC outlet (not shown) on a side of the base unit 20 and at a second end to a wall outlet to charge the battery 36.

The illumination assembly 32 can be arranged to illuminate when the cover 16 is not in the first secured position, i.e. removed from the base unit 20. The illumination assembly 32 can further illuminate when the cover 16 is placed (i) in a second secured position on the second side of the base unit 20, or (ii) to the bottom side of the bottommost modular storage unit 50, 60, 70, 80, and 90.

More particularly, the illumination assembly 32 can be electrically connected to at least one switch (not shown). The switch can be connected such that the illumination assembly 32 can be turned on, turned off, or otherwise modulated. The switch can be a switch of any suitable type to switch low voltage current. For example, the switch can be a push-button switch, a membrane-type switch, or the like. The switch can be activated by a person or the switch can be activated by a mechanical or electrical source. For example, the switch can be a friction-type switch such that the illumination assembly 32 is deactivated or turned off when the cover 16 is attached to the first top side of the base unit 20, and is activated or turned on when the cover 16 is detached from the first top side of the base unit 20. The friction-type switch can activate or turn on the illumination assembly 32 when the cover 16 is attached to the second bottom side of the base unit 20 (or one of the modular storage units 50, 60, 70, 80, and 90) and can deactivate or turn off the illumination assembly 32 when the cover 16 is detached from the second bottom side of the base unit 20 (or one of the modular storage units 50, 60, 70, 80, and 90). The switch can be a motion switch such that, for example, the illumination assembly 32 is activated when the cover 16 is detached from the first top side of the base unit 20 and the base unit 20 is subject to horizontal, lateral, vertical, or the like, motion. The switch can also include a timer such that illumination assembly 32 can be turned off or deactivated after, for example, 2, 5, or 10 minutes, or the like.

The illumination assembly 32 can be located at any suitable location or locations on the base unit 20. For example, the illumination assembly 32 can be located immediately adjacent to the mirror or magnifying device 14 such that the illumination assembly 32 can rotate as the mirror or magnifying device 14 rotates. For further example, the illumination assembly 32 can be located on a first side of the base unit 20 such that the illumination assembly 32 always directs light in a specific, discrete direction. For example, the illumination assembly 32 can be located on a first side of the base unit 20 such that the illumination assembly 32 directs light in a broad, general direction to provide an area-wide lighting effect.

According to various embodiments, the modular storage container 10 can include a diffusion cover 30. The diffusion cover 30 can be situated such that the diffusion cover 30 is between the illumination assembly 32 and a person using the modular storage container 10. For example, the diffusion cover 30 can be situated between the illumination assembly 32 and a person who is looking into the mirror 14 while applying makeup. The diffusion cover 30 can be flush with or form a surface of the base unit 20.

The diffusion cover 30 can, for example, soften or diffuse the light from the illumination assembly 32. For further example, the diffusion cover 30 can filter the light from the illumination assembly 32. The diffusion cover 30 can be translucent. The diffusion cover 30 can, for example, allow 90, 80, 70, 60, or 50 percent, or the like, of the light from illumination assembly 32 to transmit or pass through diffusion cover 30. Diffusion cover 30 can act as a diffusion grating. The diffusion cover 30 can act as a monochromator. The diffusion cover 30 can restrict transmittance of light to a certain discrete wave length, range of wavelengths, series of wavelengths, and the like.

The diffusion cover 30 can be tinted or colored. The diffusion cover 30 can be tinted or colored to filter light from the illumination assembly 32. The colors can be used to simulate, for example, outdoor lighting conditions, indoor lighting conditions, evening lighting conditions, or the like, such that a person applying makeup could simulate lighting conditions different from the lighting conditions at the time that the person is applying makeup. The diffusion cover 30 can be adapted to be removed and replaced by a user such that a diffusion cover 30 could be removed and replaced with a second diffusion cover (not shown) that is tinted or not tinted, as desired by the user. According to various embodiments, the modular storage container 10 can include more than one replaceable diffusion covers 30.

The diffusion cover 30 can be adapted to accept a filter (not shown) such that a person could removably affix same in order to filter the light from illumination assembly 32. The filter can be, for example, a colored gel or the like. The filter can be used to simulate, for example, outdoor lighting conditions, indoor lighting conditions, evening lighting conditions, or the like, such that a person applying makeup could simulate lighting conditions different from the lighting conditions at the time that the person is applying makeup.

The diffusion cover 30 can be tinted or colored with more than one tint or more than one color. For example, the diffusion cover 30 can be tinted a first color while a different section of the diffusion cover 30 can be tinted a second color. The illumination assembly 32 can include more than one source 34 such that, for example, a first LED is situated under the diffusion cover 30 having a first tint and a second LED is situated under the diffusion cover 30 having a second tint. Illumination assembly 32 can be configured such that only the first LED can illuminate when a switch is operated a first time, only the second LED can illuminate when the switch is operated a second time, and the first and second LEDs can illuminate when the switch is operated a second time. A mechanical method of blocking illumination of one or more point sources of light, such as a removable zero percent light transmittance filter, can be used. Any suitable combination, number, or configuration of color, tint, illumination source, bulb, diffusion grating, or filter can be employed.

Figure 6:
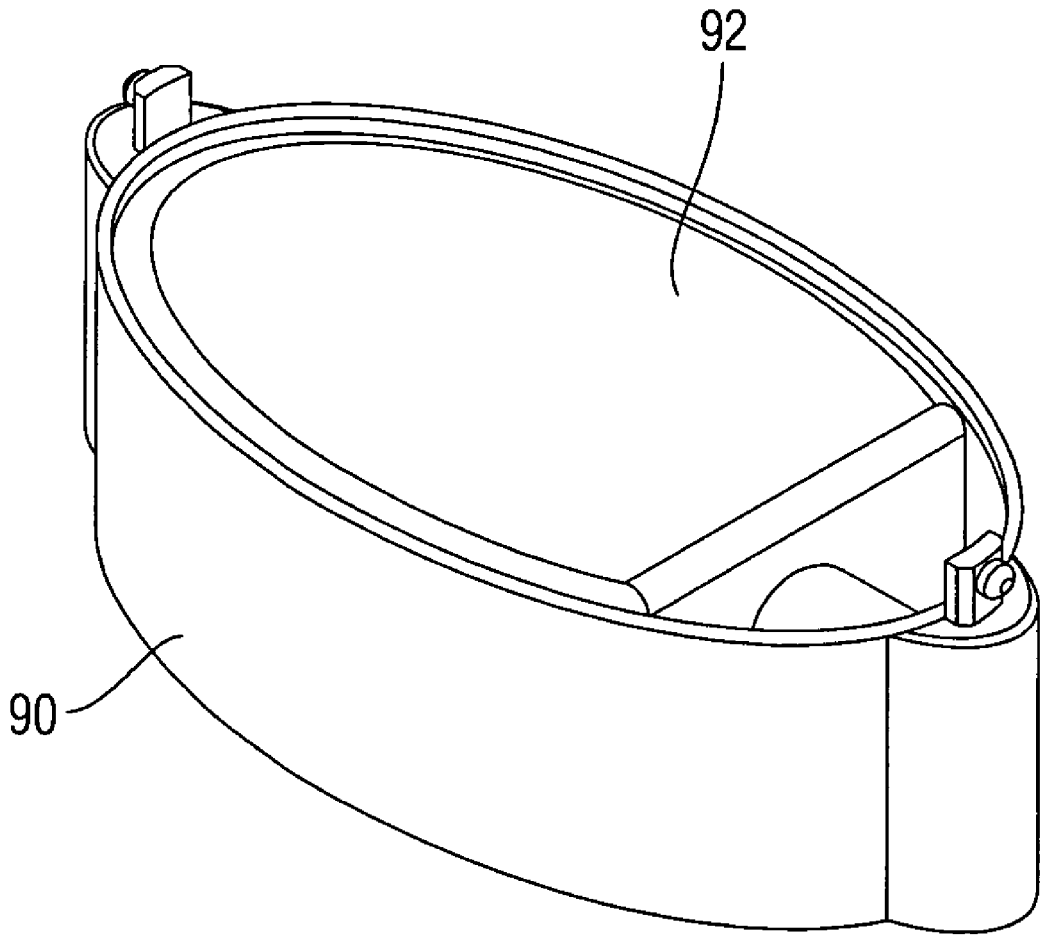
FIG. 6 is a perspective view of a modular storage unit that is adapted to house a refillable container or other articles.

As shown in FIG. 1, a modular storage unit, such as, for example, unit 50, can be adapted to contain, for example, at least one lipstick tube, mascara, eye liner, and/or an eyebrow pencil. Another modular storage unit, such as, for example, unit 60, can be adapted to contain, for example, removable eye shadow/lip gloss cases and/or an applicator. Another modular storage unit, such as, for example, unit 70 can be adapted to contain a removable compact and/or an applicator. Another modular storage unit, such as, for example, unit 80 can be adapted to contain, for example, removable blush and/or an applicator. Another modular storage unit, such as, for example, unit 90 can be adapted to contain, for example, mascara and/or eyeliner and/or an eyebrow pencil. Alternatively, unit 90 (or any other modular storage unit) can be adapted to contain a liquid. As shown in FIG. 6, unit 90 can be adapted to house a refillable container 92. The container 92 can be a form-fitting, liquid-tight, refillable container that fits within modular storage unit 90, as shown in FIG. 6, or the container can be integrally formed as part of the modular storage unit 90. Alternatively and still referring to FIG. 6, unit 90 (or any other modular storage unit) can be adapted to house a memory material 92 which could be adapted to take on the shape of any article stored in the respective modular storage unit. Such a material could be a memory foam, rubber, gel, or any other similar conformable material.

The modular storage units can be adapted to contain, for example, one or more removable small jars, for example, jars of foundation or mineral foundation, jars of loose powder, or the like. Modular storage units can also be adapted to contain, for example, miscellaneous makeup tools or the like, for example, blush brushes, eyeliner pens, applicators, or the like. Modular storage units can also be adapted to contain any suitable small items useful for daily life, for example, extra keys, contact lenses and solutions, sewing accessories, chewing gum, and the like.

As shown in FIGS. 1 and 2*a*-2*d*, the base unit 20, cover 16, one or more modular storage units 50, 60, 70, 80, 90, and combinations thereof, can each be detachably connected. They can be detachably connected using any suitable means, such as, for example, using a friction fit and/or by way of interconnecting snaps, and the like.

As shown in FIG. 1, a top end side of a modular storage unit can include a male connector 42 that can connect into a complementary-shaped female connection (not shown) formed on a bottom side of a neighboring modular storage unit or in the base unit 20. According to various embodiments, the components can then be disconnected by any suitable means, such as, for example, pressing a button to release the connection or by pulling gently to overcome a friction fit, and the like. Such detachable connections allow the base unit 20 and the one or more modular storage units 50, 60, 70, 80, 90 to be connected in various combinations depending on the storage needs of the user.

Figure 5:
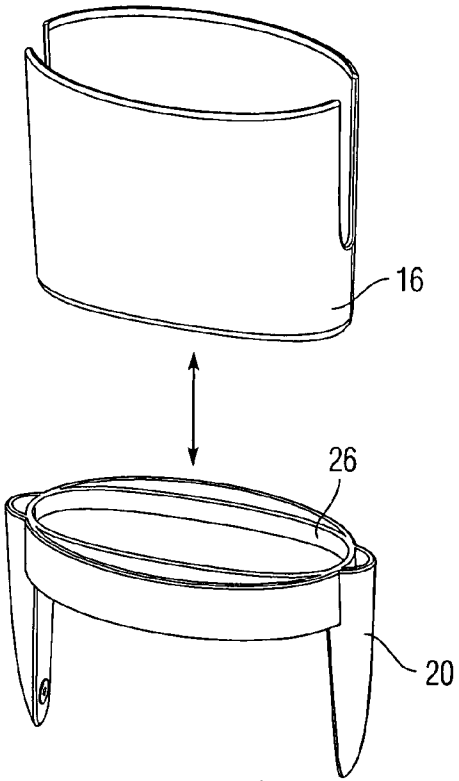
FIG. 5 is an upside-down perspective view of the modular storage container of the present teachings with the cover being inserted into a second bottom side of the base unit.

As shown in FIGS. 3 and 5, in a second secured position of the removable cover 16, the second or bottom side of the base unit 20 can be arranged to connect with the cover 16. For example, a second end of the removable cover 16 can be arranged to secure to a second side of base unit 2 by way of a friction fit. As shown in FIG. 5, the friction fit can be achieved by a complimentary-shaped ring 26 arranged on the bottom side of the base unit 20. In a similar manner, the removable cover 16 can also be secured to the second side of a modular storage unit, such as unit 50, 60, 70, 80, and 90. As shown in FIG. 3, the removable cover 16 can operate to elevate and secure the base unit 20 (and any optionally secured modular storage units 50, 60, 70, 80, 90) so that a user can more readily use and manipulate the mirror or magnification device when applying makeup, and the like.

Figure 2A:
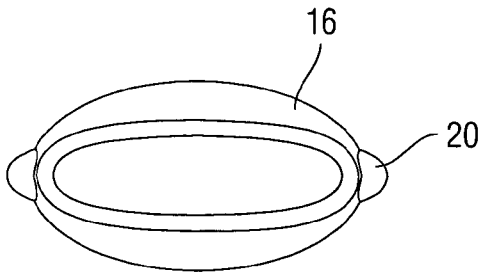
FIG. 2*a* is a top view of the modular storage container of the present teachings.
Figure 2B:
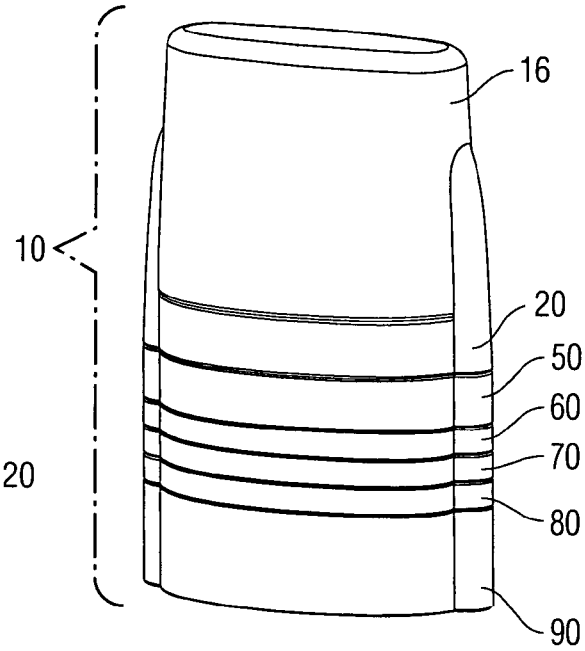
FIG. 2*b* is a perspective view of the modular storage container of the present teachings.
Figure 2C:
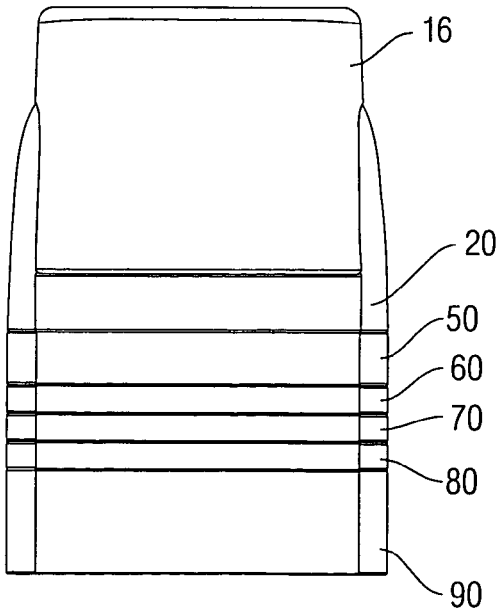
FIG. 2*c* is a front view of the modular storage container of the present teachings.
Figure 2D:
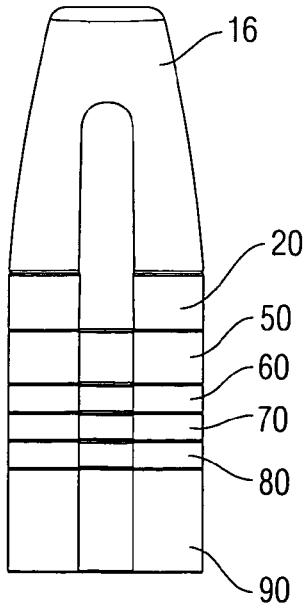
FIG. 2*d* is a side end view of the modular storage container of the present teachings.

As shown in FIGS. 2*b*, 2*c*, and 2*d*, when the cover 16, base unit 20, and one or more modular storage units 50, 60, 70, 80, 90, are connected in a stacked relationship, the exterior surfaces thereof are arranged to provide the modular storage container 10 with a sleek and stylish design. For example, this can be achieved by providing exterior surfaces which can align in a flush relationship with each other.

Those skilled in the art can appreciate from the foregoing description that the present teachings can be implemented in a variety of forms, shapes, and sizes. Therefore, while these teachings have been described in connection with particular embodiments and examples thereof, the true scope of the present teachings should not be so limited. Various changes and modifications may be made without departing from the scope of the teachings herein.

What is claimed is:

1. A modular storage container, comprising:

a base unit having a first side and a second side;

one of a mirror and a magnifying device being supported on the first side of the base unit by way of at least one support extending outwardly from the first side of the base unit;

an illumination assembly arranged on the base unit; and a cup-shaped removable cover including a closed end and an open end, the open end of the cup-shaped removable cover configured to extend around one of the mirror and the magnifying device and secure to the first side of the base unit to cover and protect one of the mirror and the magnifying device within the cup-shaped removable cover in a first secured position of the cover;

wherein the second side of the base unit is configured to be removably securable to one of a plurality of modular storage units.

2. The modular storage container of claim 1, wherein the second side of the base unit is securable to the cover in a second secured position of the cover.

3. The modular storage container of claim 1, wherein the first side of the base unit is securable to a first end of the cover and the second side of the base unit is securable to a second end of the cover.

4. The modular storage container of claim 1, wherein the illumination assembly includes at least one light emitting diode (LED).

5. The modular storage container of claim 1, wherein the illumination assembly includes a battery.

6. The modular storage container of claim 1, wherein the illumination assembly includes a switch.

7. The modular storage container of claim 1, wherein the illumination assembly illuminates when the cover is removed from the first secured position.

8. The modular storage container of claim 2, wherein the illumination assembly illuminates when the cover is placed in the second secured position.

9. The modular storage container of claim 3, wherein the illumination assembly illuminates when the second end of the cover is secured to the second side of the base unit.

10. The modular storage container of claim 1, further comprising a diffusion cover arranged on the illumination assembly.

11. The modular storage container of claim 1, wherein one of the mirror and magnifying device is arranged relative to the base unit such that the mirror can pivot.

12. The modular storage container of claim 11, wherein one of the mirror and magnifying device can pivot about the at least one support extending outwardly from the base unit.

13. The modular storage container of claim 1, wherein the cup-shaped removable cover is independently separable from the first side of the base unit.

14. The modular storage container of claim 1, wherein the mirror is configured to magnify an image appearing in the mirror.

15. The modular storage container of claim 1, wherein the magnifying device includes a magnifying glass.

16. The modular storage container of claim 1, wherein at least one modular storage unit is configured to contain at least one lipstick tube.

17. The modular storage container of claim 1, wherein at least one modular storage unit is configured to contain a replaceable makeup container.

18. The modular storage container of claim 1, wherein at least one modular storage unit is configured to contain a memory material.

19. The modular storage container of claim 1, wherein the illumination assembly is arranged on the first side of the base unit.

20. The modular storage container of claim 19, wherein the removable cover surrounds and protects one of the mirror and magnifying device, as well as the illumination assembly in a first secured position of the cover.

21. A modular storage container, comprising:

a base unit having a first side and a second side;

one of the mirror and magnifying device supported on the first side of the base unit by way of at least one support extending outwardly from the first side of the base unit;

an illumination assembly arranged on the base unit; and a cup-shaped removable cover including a closed end and an open end, the open end of the cup-shaped removable cover configured to extend around one of the mirror and the magnifying device and secure to the first side of the base unit to cover and protect one of the mirror and magnifying device within the cup-shaped removable cover in a first secured position of the cover, the removable cover being configured to secure to the second side of the base unit in a second secured position of the cover such that the removable cover acts as an elevating support for the base unit in the second secured position of the cover.

* * * * *